US007658175B2

(12) United States Patent
Sugishita et al.

(10) Patent No.: US 7,658,175 B2
(45) Date of Patent: Feb. 9, 2010

(54) ENGINE START DEVICE

(75) Inventors: Yuu Sugishita, Kawagoe (JP); Kazuo Nakajima, Kawagoe (JP)

(73) Assignee: Zenoah Co., Ltd., Saitama (JP)

( * ) Notice: Subject to any disclaimer, the term of this patent is extended or adjusted under 35 U.S.C. 154(b) by 0 days.

(21) Appl. No.: 11/915,426

(22) PCT Filed: Dec. 20, 2005

(86) PCT No.: PCT/JP2005/023375

§ 371 (c)(1),
(2), (4) Date: Dec. 31, 2007

(87) PCT Pub. No.: WO2007/072550

PCT Pub. Date: Jun. 28, 2007

(65) Prior Publication Data

US 2008/0283017 A1 Nov. 20, 2008

(51) Int. Cl.
*F02N 1/00* (2006.01)
*F02N 15/04* (2006.01)

(52) U.S. Cl. ..... 123/185.14; 74/8

(58) Field of Classification Search ..... 123/185.3, 123/185.14; 74/8
See application file for complete search history.

(56) References Cited

U.S. PATENT DOCUMENTS 3,010,443 A * 11/1961 Lyvers ..... 123/185.14
4,104,927 A * 8/1978 Jensen et al. ..... 123/185.14
4,480,605 A * 11/1984 Bloemers ..... 123/185.3
4,582,030 A * 4/1986 Reese ..... 123/185.3
5,163,392 A * 11/1992 Morishima et al. ..... 123/179.25
5,186,134 A * 2/1993 Morishima et al. ..... 123/179.5
5,537,966 A * 7/1996 Ohnishi ..... 123/185.14
6,263,852 B1 * 7/2001 Gracyalny et al. ..... 123/185.14
6,325,036 B1 * 12/2001 Gracyalny et al. ..... 123/185.14
6,508,220 B1 * 1/2003 Akaike et al. ..... 123/185.14
6,615,787 B2 * 9/2003 Gracyalny ..... 123/185.14
6,679,217 B2 * 1/2004 Nieda et al. ..... 123/185.14
6,827,055 B2 * 12/2004 Tsunoda et al. ..... 123/185.14
6,901,899 B2 * 6/2005 Tsunoda et al. ..... 123/185.14
7,252,065 B1 * 8/2007 Keeton ..... 123/185.14
2002/0121258 A1 * 9/2002 Nieda et al. ..... 123/185.14
2002/0157632 A1 * 10/2002 Nemoto et al. ..... 123/185.14
2002/0174848 A1 * 11/2002 Nieda et al. ..... 123/185.14

FOREIGN PATENT DOCUMENTS

JP 1-91075 A 6/1989

(Continued)

*Primary Examiner*—Stephen K Cronin
*Assistant Examiner*—David Hamaoui
(74) *Attorney, Agent, or Firm*—Darby & Darby P.C.

(57) ABSTRACT

An engine start device having a first start mode in which the engine is started on a spot by executing a start operation of the engine, and a second start mode in which a necessary accumulated force is previously accumulated in to start in one time in an optional place at an optional timing. In the first start mode, an accumulated force, accumulated by a rotation of a rotation drive section allows the engine to be started on the spot. If switched to the second start mode, the rotation of the rotation drive section is exclusively accumulated and released in the optional place at a desired time so as to start the engine in accordance with a one-touch operation.

6 Claims, 8 Drawing Sheets

FOREIGN PATENT DOCUMENTS

| | | |
|---|---|---|
| JP | 1191075 | 6/1989 |
| JP | 1139080 | 9/1989 |
| JP | 5223025 | 8/1993 |
| JP | 200165435 | 3/2001 |
| JP | 2001132591 | 5/2001 |
| JP | 2002327666 | 11/2002 |
| JP | 2003269300 | 9/2003 |
| JP | 2004068639 | 3/2004 |
| JP | 2004116388 | 4/2004 |
| JP | 2004263615 | 9/2004 |
| JP | 2005337224 | 12/2005 |
| JP | 2005351188 | 12/2005 |

* cited by examiner

ENGINE START DEVICE

CROSS REFERENCE TO RELATED APPLICATIONS

This is a U.S. national phase application under 35 U.S.C. § 371 of International Patent Application No. PCT/JP2005/023375 filed Dec. 20, 2005. The International Application was published in Japanese on Jun. 28, 2007 as International Publication No. WO 2007/072550 A1 under PCT Article 21(2), the content of which is incorporated herein in its entirety.

TECHNICAL FIELD

The present invention relates to a start device for an internal combustion engine, and more particularly to a compact engine start device which can smoothly start via damping and accumulating means such as an accumulating spring in accordance with a pulling operation of a recoil rope, in which the engine start device can make the pulling operation of the recoil rope unnecessary in a place where the pulling operation of the recoil rope is hard, can safely and securely start the engine in optional timing and place, and can prevent the engine from being carelessly started.

BACKGROUND ART

A manual start device for an internal combustion engine generally rotates a rope reel by pulling a recoil rope and executes an engine start by transmitting the rotation of the rope reel to a crank shaft of the engine. However, in this kind of engine start device, not only it is necessary to forcefully pull the recoil rope in a state of making a pulling speed of the recoil rope higher to some degree, but also a pulling length is long. Accordingly, in many cases, an aged person and a weak person can not easily start the engine. Then, the engine start device by which even the person having a small pulling force of the recoil rope can easily start the internal combustion engine has proposed, for example, by Japanese Utility Model Application Laid-Open (JP-U) No. 1-91075 (patent document 1), Japanese Patent Application Publication (JP-B) No. 52-23025 (patent document 2), Japanese Patent Application Laid-Open (JP-A) No. 2001-132591 (patent document 3), JP-A-2002-327666 (patent document 4), JP-A-2003-269300 (patent document 5), and JP-A-2001-65435 (patent document 6).

Among them, in accordance with the engine start device of the patent document 1, there are provided with a recoil drum around which a recoil rope is wound; a first power spring which urges in a direction of winding the recoil rope around the recoil drum; a first ratchet formed in the recoil drum; a second ratchet which engages with a second ratchet pawl provided in a crank shaft of the engine at a time of rotating in the engine start direction; a second power spring coupled to the second ratchet to accumulate a spring force rotating the ratchet in the engine start direction; a first ratchet pawl provided in the second ratchet, the a first ratchet pawl engaging with the first ratchet and transmitting the rotation of the recoil drum to the second power spring via the second ratchet to accumulate the spring force in the power spring; and a stopper member which detachably engages with the second ratchet and inhibits the rotation of the second ratchet generated by the spring force of the second power spring, which are arranged coaxially.

In order to start the engine by means of the start device, the stopper member is previously engaged with the second ratchet, a sufficient force is accumulated in the second power spring by pulling the recoil rope at a proper frequency so as to rotate the recoil drum, and the engagement between the stopper member and the second ratchet is detached at a time of starting the engine, thereby rotating the crank shaft by the spring force of the second power spring so as to start the engine. In the case that the spring force is accumulated in the second power spring, the power spring is only rotated, and any load from the engine is not applied. Accordingly, the small pulling force of the recoil rope is sufficient, even the weak person can easily execute the pulling operation of the recoil rope and it is possible to securely start the engine at a necessary time.

On the other hand, the engine start devices in the patent documents 2 to 5 exclude the stopper member from the engine start device in the patent document 1, and is structured such that the spring force of the second power spring is not released until the spring force accumulated in the second power spring gets over a maximum load in a compression stroke of the engine, and the spring force is released in a moment when the spring force of the second power spring gets over the maximum load in the compression stroke of the engine so as to rotate a crank, thereby automatically starting the engine.

In this case, the patent documents 3 and 4 are different only in a part of the mechanism, and are substantially provided with the function mentioned above. The different point of the mechanism exists in a point that the patent document 3 is structured such that a power spring accommodating box corresponding to a part of the damping and accumulating means is supported to a supporting shaft via a one-way clutch, and the patent document 4 is structured such that the power spring accommodating box is rotatably supported to the supporting shaft, and one-way rotating means allowing only a rotation in an engine rotating direction is provided in an outer peripheral portion of the power spring accommodating box. As mentioned above, since the one-way rotating means is provided in the outer peripheral portion of the power spring accommodating box, the structure is more advantageous in design and work in comparison with the case that the one-way rotating means is provided in the rotating shaft portion. In any case, in the engine start devices of the patent documents 3 and 4, the structure is made such that the power spring accommodating box can be rotated only in one direction in accordance with the pulling operation of the recoil rope, thereby maintaining the spring force accumulated in the power spring.

On the other hand, in the patent document 5 mentioned above, the power spring accommodating box integrally formed with the rope reel winding the recoil rope is rotatably supported to the supporting shaft without interposing the one-way clutch or the like. If the pulling operation of the recoil rope for accumulating the force in the power spring is interrupted in process of the operation, the power spring accommodating box is reverse rotated together with the reel for the coil in the reverse direction to the driving direction of the engine so as to release the spring force of the power spring.

Further, the engine start device in the patent document 6 mentioned above is provided with a power spring force accumulating mechanism, a manual rope reel which accumulates a rotating force in the power spring force accumulating mechanism, a reset lever having a stopper for inhibiting a rotation in an output side of the power spring force accumulating mechanism to hold the accumulated rotating force to a predetermined torque, and a transmission mechanism which transmits the accumulated rotating force to a crank shaft of an internal combustion engine at a time when the stopper is disengaged. In this case, the reset lever can be manually switched from a stop position to a free position, and can automatically start the engine on the basis of the same operation as the patent document 3 mentioned above. In other words, in accordance with the engine start device, the stopper exists at the stop position in a steady state until the reset lever is operated so as to be set to the free position, thereby inhibiting the rotation in the output side of the power spring force accumulating mechanism. In this state, a sufficient accumulated force for starting the engine is stored in the power spring force accumulating mechanism by pulling the recoil rope at several times, and if the sufficient accumulated force is stored, the reset lever is automatically moved to the free position so as to start the engine at the same time. Therefore, even the weak person can easily operate the engine.

In this case, in accordance with the engine start device in the patent document 1 mentioned above, the second ratchet is rotated together with the recoil drum and a case fixing an outer end portion of the second power spring even if the recoil rope is pulled at a time when the stopper member is not engaged with the second ratchet. Accordingly, the spring force is not accumulated in the second power spring, and the engine can not be started. Therefore, in order to start the engine by this engine start device, it is necessary to necessarily engage the stopper member with the second ratchet previously. Further, in accordance with the start device, since the desired spring force can not be accumulated until plural times of pulling operations of the recoil rope are executed, it takes a lot of trouble for the operator having the normal force to start, and the operator can not be ever used to the operation.

On the other hand, in the engine start device in the patent documents 2 to 5, the engine can be automatically started only by pulling the recoil rope. Thus, a working efficiency is improved as far as a working field in which a working space is wide and stable. However, for example, in the case that it is intended to execute a pruning of a tree by using a chain saw mounting the engine start device therein, most of the working field is necessarily high and has an unstable scaffold, and the other branches and leaves protrude around the working field. Accordingly, it is unavoidable that the work would be done in the severe and narrow space where a large pulling operation of the recoil rope is hard to be executed. In the working field which is high and is hard to secure the scaffold, the operator takes to the working field in a state of keeping the engine stop, in the same manner as the general working field, and the operator starts the engine by largely pulling the recoil rope. At this time, in many cases, the pulling operation of the recoil rope can not be well executed by being obstructed by the branches and leaves therearound or preventing the scaffold from being fixed.

Further, the engine start devices disclosed in the patent documents 2 to 5 mentioned above may be loaded in a back type structure executing a work wile having the engine on the operator's back, for example, a bush cutter or the like. The back type bush cutter is structured such that an engine and a long operation tube are connected by a flexible pipe, a flexible shaft is inserted to the flexible pipe so as to be connected to a transmission shaft inserted to the operation tube, and a rotating blade attached to a leading end of the operation tube is rotated on the basis of the rotation of the transmission shaft. Further, a plurality of wires and lead wires are interposed in addition to the flexible pipe between the engine and a connection end portion of the operation tube. In order to start the engine of the back type bush cutter mentioned above, for example, the long operation tube is gripped by a left hand, and the pulling operation of the recoil rope is executed by a right hand.

The pulling operation at this time is achieved by pulling the operation handle of the recoil rope from a near side to a forward side because the operator has the engine on the back. This operation not only be extremely hard to be executed but also require an extremely great pulling force, in comparison with the case of pulling the recoil rope to the near side. Even in the course of the engine start operation, it is necessary to hold the rotating blade in the leading end in the air while paying attention to the periphery in an unstable state of griping the near side end portion of the long operation tube by the left hand.

Particularly, in the engine start devices of the patent documents 3 and 4 mentioned above, even if the recoil rope is automatically returned to the original state in the state in which the rope is wound around the rope reel, by interrupting the pulling operation of the recoil rope halfway, the force accumulated in the power spring is maintained as it is because the power spring accommodating box is stopped its reverse rotation by the one-way rotating means. There tends to be generated a situation that the accumulated force is released by some chance and the engine is accidentally started by the releasing fore. In this regard, in the engine start device of the patent document 5 mentioned above, even if the pulling operation of the recoil rope is interrupted halfway and the recoil rope is released, the power spring accommodating box and the rope reel are reversely rotated together on the basis of a reaction force of the accumulated spring force, and the recoil rope is automatically rewound and the accumulated force of the power spring is automatically released. Accordingly, the engine is not accidentally started.

On the other hand, in accordance with the engine start device disclosed in the patent document 6 mentioned above, in a state in which the stopper is applied, a reset lever is automatically moved so as to disconnect the stopper at a state that a force sufficient for starting the engine is accumulated in the damping and accumulating means by pulling the recoil rope, thereby automatically starting the engine. Accordingly, it is impossible to optionally select the start timing of the engine even in this device. Further, in order to move the reset lever to the free position so as to start the engine, it is necessary to largely and quickly pull the recoil rope in the same manner as the conventional one. Therefore, in the high location mentioned above in which it is necessary to strongly and quickly pull the recoil rope and working field in which the pulling operation of the recoil rope is hard because the peripheral operation space is narrow, it is necessary to start the engine by pulling the recoil rope several times in the field. In the case that this pulling operation is impossible, it is necessary to execute a manual work that leas to an extremely inefficient work.

In the engine device disclosed in the patent document 1 mentioned above, it is completely silent about how many times the pulling operation of the recoil rope is necessary for obtaining a sufficient accumulated force for starting the engine in the power spring. Therefore, in many case, the pulling operation of the recoil rope is executed at an extra frequency. If the frequency of the pulling operation of the recoil rope is small, not only the engine is not started even by detaching the stopper, but also the long-awaited accumulated force accumulated in the power spring is released. Further, in the engine start device of the patent document 2, the engine is started by two times pulling operations. However, the start is not achieved by the spring force, or there is a risk that the engine is started early. On the other hand, the patent documents 3 to 5 can not forecast the timing at which the sufficient accumulated force for starting the engine is accumulated in the power spring. Accordingly, the spring force of the power spring is changed in a long-term use, a deviation tends to be generated in the start timing of the engine, and it is impossible to forecast the deviation. Thus, in many cases, a fear is generated at a time of starting.

In this regard, in the engine start device of the patent document 6 mentioned above, if the sufficient accumulated force for starting the engine is accumulated in the power spring at a time of the pulling operation of the recoil rope, the engine is automatically and securely started. Accordingly, the over-and-short pulling operation is not generated. However, it is hard to forecast the start timing in the same manner as the patent documents 2 to 5 mentioned above, and it is impossible to previously execute the pulling operation of the recoil rope so as to start the engine on the basis of a simple operation at an optional timing in an optional place.

SUMMARY OF THE INVENTION

The present invention has been made for the purpose of simultaneously solving the various problems of the conventional manual type engine start devices mentioned above, and a specific object of the present invention is to provide an engine start device which can easily start an engine only by a pulling operation of a recoil rope in a working field in which a start operation of the engine is easy, and can previously accumulate a necessary and sufficient force in damping and accumulating means on the basis of the pulling operation of the recoil rope, and execute a one-touch start after going to the field in a state of stopping the engine, in the case of a work in the field in which the start operation of the engine is hard.

The object mentioned above can be efficiently achieved by the following basic structure. In other words, in accordance with the present invention, there is provided an engine start device including: a rotation drive section rotated only by an operation of the recoil rope; a rotation driven section to which a rotation of the rotation drive section is transmitted; and damping and accumulating means interposed between the rotation drive section and the rotation driven section, the damping and accumulating means accumulating a force while damping on the basis of a driving of the rotation drive section in a process of the driving the rotation drive section, and driving the rotation driven section on the basis of the accumulated force, wherein the damping and accumulating means has mode switching means for switching a mode from a first start mode in which the rotation of the rotation drive section is directly transmitted to the rotation driven section via the damping and accumulating means, to a second start mode in which the rotation of the rotation drive section exclusively accumulates the force in the damping and accumulating means and releases the accumulated force accumulated in the damping and accumulating means at a desired time so as to rotate the rotation driven section, and the mode switching means has first and second engaging and disengaging members which engage with and disengage from each of the damping and accumulating means and the rotation driven section so as to respectively inhibit and allow a reverse rotation of the damping and accumulating means and the rotation driven section, and single operating means which engages with and disengages from in cooperation with the first and second engaging and disengaging members.

It is desirable that the first and second engaging and disengaging means are engaged with the damping and accumulating means and the rotation driven section at a time of the second start mode on the basis of an operation of the switch operating means in such a manner that an engagement of the first engaging and disengaging member is disengaged after a desired time has elapsed after disengaging the second engaging and disengaging member by a time difference mechanism.

In accordance with a further preferable aspect, the damping and accumulating means has a barrel drum rotated by the rotation drive section and a power spring, the rotation drive section having a one-way rotating mechanism, the first engaging and disengaging member is pivoted to a cover case of the start device, and integrally has an engaging and disengaging portion which is urged toward an engaging and disengaging portion disposed around the barrel drum, and an operating portion in cooperation with the second engaging and disengaging member so as to rotate the engaging and disengaging portion in an engaging and disengaging direction, and the second engaging and disengaging means is pivoted to the cover case, and integrally has an engaging and disengaging pawl portion which is urged in a locking direction constituting part of the one-way rotating mechanism of the rotation driven section, and an operating portion connected to the operating means so as to engage and disengage the engaging and disengaging pawl portion with and from the rotation driven section. In this case, each of the first and second engaging and disengaging members is formed in an L-shaped member, a center portion thereof being pivoted to the cover case.

Further, although not being necessarily provided in the present invention, it is preferable to be further provided with a torque limit mechanism which operates at a time when the accumulated force by the damping and accumulating means exceeds a necessary load for starting the engine. In this case, the torque limit mechanism comprises signal generating means for generating a signal at the time when the accumulated force by the damping and accumulating means exceeds the necessary load for starting the engine.

The damping and accumulating means is characterized by having a mode switching means for switching a mode from a first start mode in which the rotation of the rotation drive section is directly transmitted to the rotation driven section via the damping and accumulating means, to a second start mode in which the rotation of the rotation drive section exclusively accumulates the force in the damping and accumulating means and releases the accumulated force accumulated in the damping and accumulating means at a desired time so as to rotate the rotation driven section, and the mode switching means has first and second engaging and disengaging members which engage with and disengage from each of the damping and accumulating means and the rotation driven section so as to respectively inhibit and allow a reverse rotation of the damping and accumulating means and the rotation driven section, and single operating means which engages with and disengages from in cooperation with the first and second engaging and disengaging members.

In the various working devices having this type of compact engine mounted therein, a start field of the engine is wide, the pulling operation of the recoil rope is safely executed in many cases, and it is preferable for a skilled worker to directly start the engine by largely pulling the recoil rope and utilizing the accumulated force of the damping and accumulating means in the same manner as the conventional one. On the other hand, it is desirable for a worker having a weak force and being unused to the start operation to securely start the engine by one simple operation at an optional timing in accordance with the operator's wish. Further, even if the skilled worker, it is more preferable to start the engine at the optional timing on the basis of the simple operation, in the work at a high location, for example, the work on the tree.

In accordance with the present invention, in the normal state, the first and second engaging and disengaging means are detached from the damping and accumulating means and the driven section, and established is the first start mode which directly transmits the rotation of the rotation driving portion to the rotation driven section via the damping and accumulating means by pulling the recoil rope so as to start the engine. Accordingly, the normal engine start executed by the skilled worker in the working place in which the pulling work is easily executed pulls the recoil rope in the field and directly transmits the rotation of the rotation drive section to the rotation driven section via the damping and accumulating means so as to start the engine. In the start operation in the high-location dangerous field or the narrow field in which the recoil rope can not be sufficiently pulled, the first start mode is switched to the second start mode in which the first and second engaging and disengaging means engage with the damping and accumulating means and the driven section so as to maintain the accumulated force in the damping and accumulating means, by operating the mode switch operating means.

If the mode is switched to the second start mode, it is possible to previously accumulate the necessary accumulated force in the damping and accumulating means by pulling the recoil rope in the state of the second start mode in the place in which the aboveground operation is easily executed, thereby maintaining the state. At this time, in accordance with the start device of the present invention, it is possible to pull the recoil rope in numbers so as to accumulate the necessary accumulated force in the damping and accumulating means. The worker goes to the field in this accumulated state, and switches the second start mode to the first start mode approximately simultaneously on the basis of one operation by the single mode switch operating means. The switching operation to the first start mode at this time not only switches the mode, but also approximately simultaneously disengages the engagement of the first and second engaging and disengaging means which engage with the damping and accumulating means and the driven section so as to discharge the accumulated force accumulated in the damping and accumulating means at a stroke and rotate the rotation driven section at a high speed, thereby starting the engine in a moment of time.

Therefore, in accordance with the present invention, in normal, the engine is started by pulling the recoil rope at a stroke in the state of the first start mode. However, in the place in which the pulling operation of the recoil rope is hard to be executed, the engine is started by switching the first start mode to the second start mode firstly, pulling the recoil rope beforehand in the place in which the pulling operation is easily executed so as to accumulate the necessary accumulated force in the damping and accumulating means, thereafter switching the mode from the second start mode to the first start mode by using the mode switch operating means, for example, a one-push changing switch or the like in the working field so as to start the engine in a moment of time. The switch mode after the engine is started is always the first start mode, that is, the state in which the first and second engaging and disengaging means are detached from the damping and accumulating means and the driven section. In this first start mode, it is possible to obtain the same function as the machine type in which the spring force accumulated in the damping and accumulating means is naturally discharged and is not maintained after interrupting the pulling operation of the recoil rope, for example, the engine start device disclosed in the patent document 4 mentioned above. In this case, even if the pulling operation of the recoil rope is interrupted so as to leave before the engine is started, the accumulated force is naturally discharged from the damping and accumulating means so as to disappear. Accordingly, it is possible to prevent the engine from being accidentally started.

As mentioned above, in accordance with the present invention, it is possible to approximately simultaneously actuate the first and second engaging and disengaging means on the basis of one operation of the single mode switch operating means so as to switch the start mode of the engine from the first start mode to the second start mode or vice versa. However, in execution of the present invention, in the state in which the force sufficient for starting the engine is accumulated in the damping and accumulating means in the second start mode, and the first and second engaging and disengaging means are engaged with the damping and accumulating means and the rotation driven section so as to intentionally stop the start of the engine. In the case of switching the second start mode to the first start mode, that is, in the case of disengaging the engagement of the first and second engaging and disengaging members engaging with the damping and accumulating means and the rotation driven section from the damping and accumulating means and the rotation driven section, the first engaging and disengaging member is disengaged after a predetermined time has elapsed after disengaging the second engaging and disengaging member by the time difference mechanism.

Since the time difference is provided in the disengagement of the engagement between the first engaging and disengaging member and the second engaging and disengaging member as mentioned above, only the engagement of the second engaging which engages with the driven section is first disengaged in the state in which the first engaging and disengaging member is engaged with the damping and accumulating means, thereby preventing the reverse rotation of the damping and accumulating means caused by the accumulated force of the damping and accumulating means so as to avoid a dispersion of the accumulated force, and transmitting the releasing force of the accumulated force transmitted from the damping and accumulating means to the crank shaft of the engine via the driven section at the same time so as to start the engine at a stroke. The engagement of the first engaging and disengaging member with the damping and accumulating means is disengaged at the same time when or just after the engine is started. As a result, almost all of the accumulated force accumulated in the damping and accumulating means is efficiently transmitted to the driven section, and it is possible to guarantee a secure engine start.

As a further preferable aspect, the damping and accumulating means has the barrel drum and the power spring rotated by the rotation driving portion, and the rotation driven section has the one-way rotating mechanism. The first engaging and disengaging member is pivoted to the cover case of the start device. The mode switch operating means is operated so that the operating portion rotates the engaging portion engaging with the barrel drum against the urging force approximately at the same time of the second engaging and disengaging member, thereby detaching the engagement with the barrel drum. At this time, the operating portion of the second engaging and disengaging member is operated slightly prior to the first engaging and disengaging member, and the engaging pawl portion engaging with the driven section is rotated against the urging force, so that the engagement with the driven section is disengaged. In this case, each of the first and second engaging and disengaging members is constituted by the L-shaped member, and the center portion thereof is pivoted to the cover case. For example, the mode switch operating means is made to be in cooperation with the operating portion of the second engaging and disengaging member on the driven section side, and the operating portion of the second engaging and disengaging member is made to be in cooperation with the operating portion of the first engaging and disengaging member. The second engaging and disengaging member can be structured, for example, so as to be engaged with and disengaged from the rotating member on the engine side. If the second engaging and disengaging member is rotated, the first engaging and disengaging member is operated together. At this time, the first engaging and disengaging member can be rotated slightly delayed from the operation of the second engaging and disengaging member, by devising the layout and the structure of the first and second engaging and disengaging members.

Further, in the case that the torque limit mechanism is further provided in the rotation portion of the engine start device mentioned above, it is possible to detect the fact that the accumulated force by the damping and accumulating means gets over the load necessary for starting the engine, thereby preventing the further accumulation. Accordingly, if the torque limit mechanism is operated, it is unnecessary to accumulate the force in the damping and accumulating means anymore. It is possible to pull the recoil rope in just proportion, and thus the unnecessary pulling operation is not required. In order to easily know the fact that the torque limit mechanism is operated, the signal generating means is operated together with the operation of the torque limit mechanism at a time when the necessary accumulated force is accumulated in the damping and accumulating means, thereby generating an informing signal, for example, a sound or a light.

DETAILED DESCRIPTION OF THE INVENTION

A description will be specifically given below of an embodiment of an engine start device of the present invention with reference to the accompanying drawings. In this case, in the present embodiment, there is exemplified a start device of a compact air-cooled internal combustion engine applied to a chain saw. However, the same kind of engine start device can be applied to a lawn mower, a rotary saw or the like.

Figure 1:
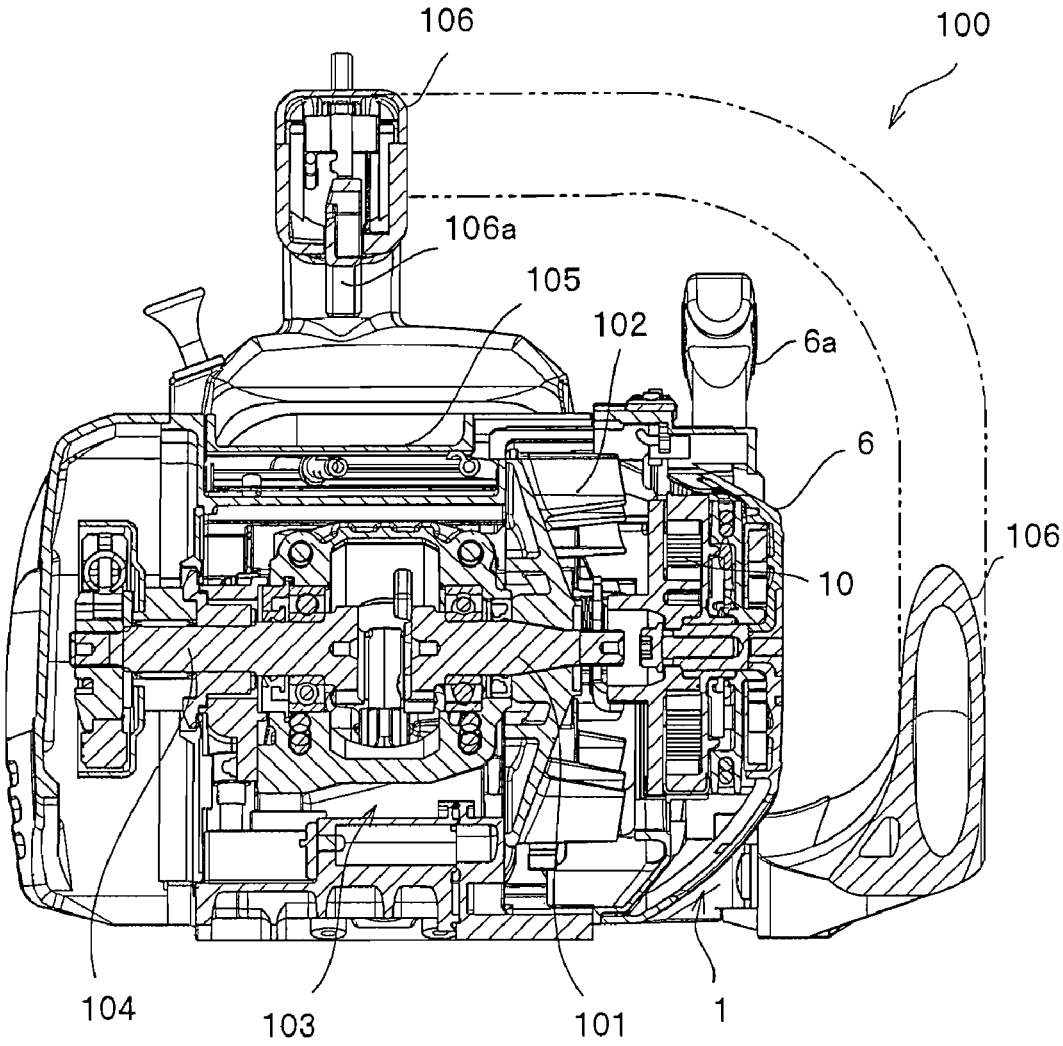
FIG. 1 is a cross sectional view showing an engine portion of a chain saw mounting an engine start device of the present invention therein.
Figure 2:
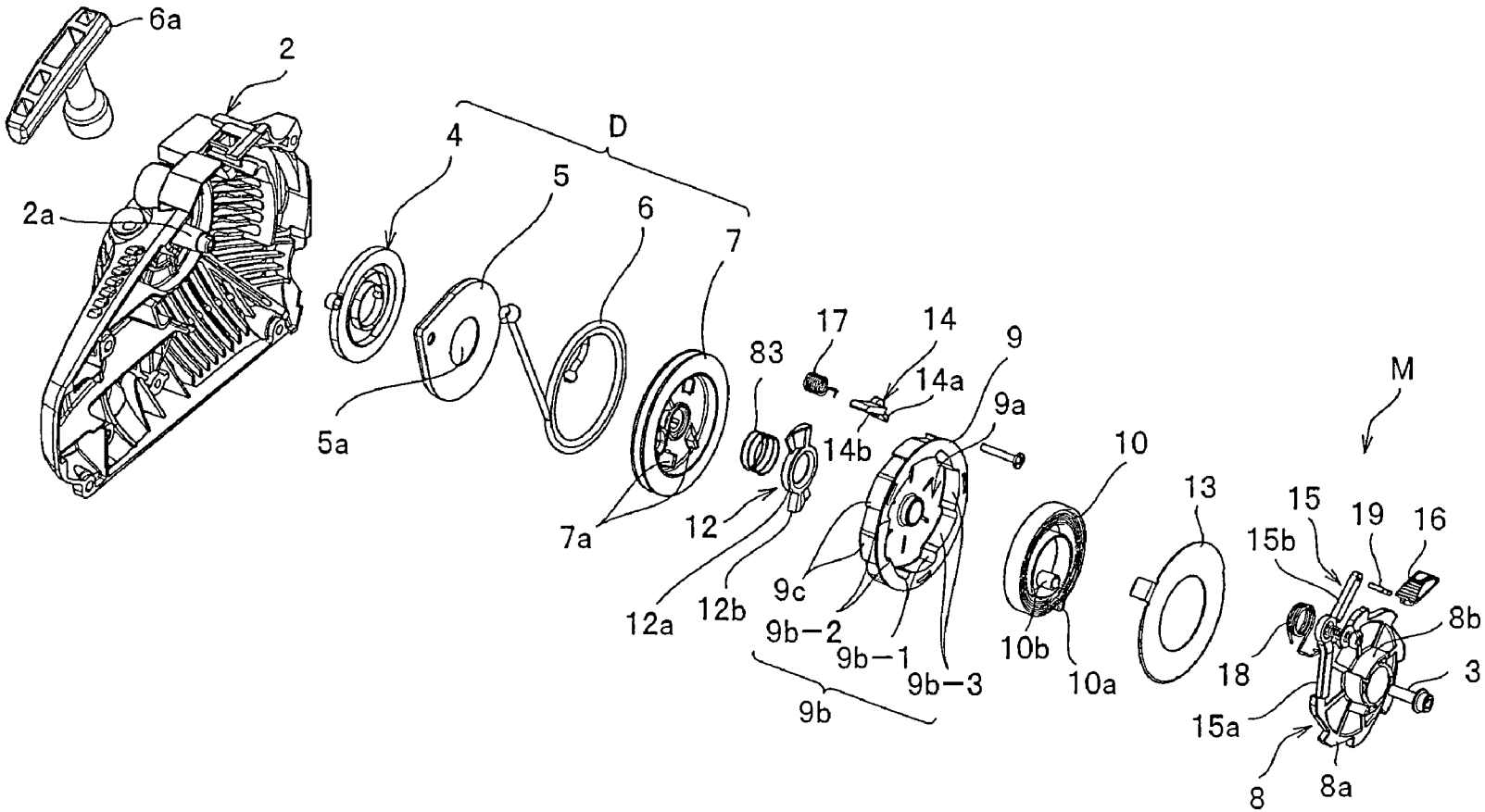
FIG. 2 is an exploded perspective view of an engine start device corresponding to a first embodiment of the present invention.
Figure 4:
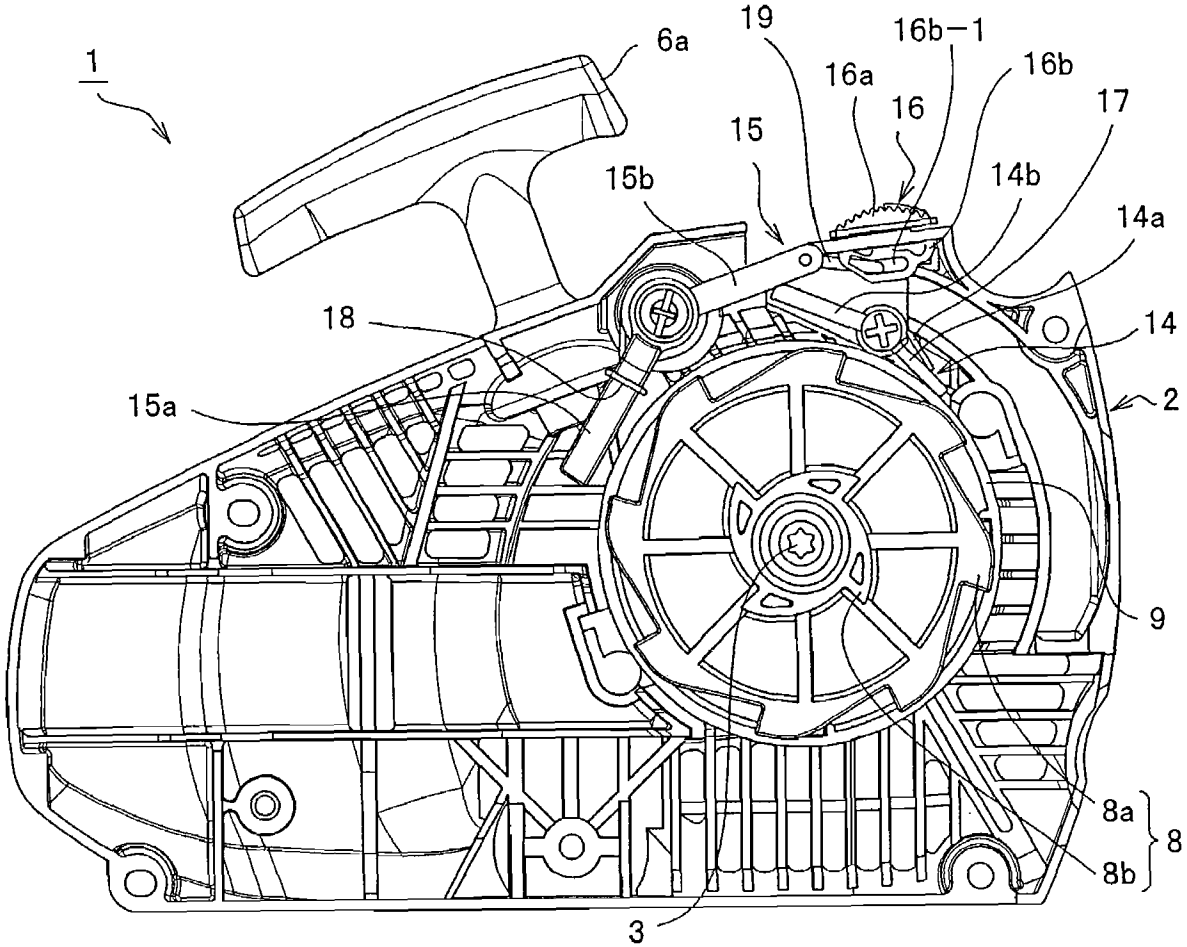
FIG. 4 is a plan view as seen from a cover case open side showing an internal state of a first start mode time of an engine corresponding to a characteristic portion of the invention in accordance with the present embodiment.
Figure 5:
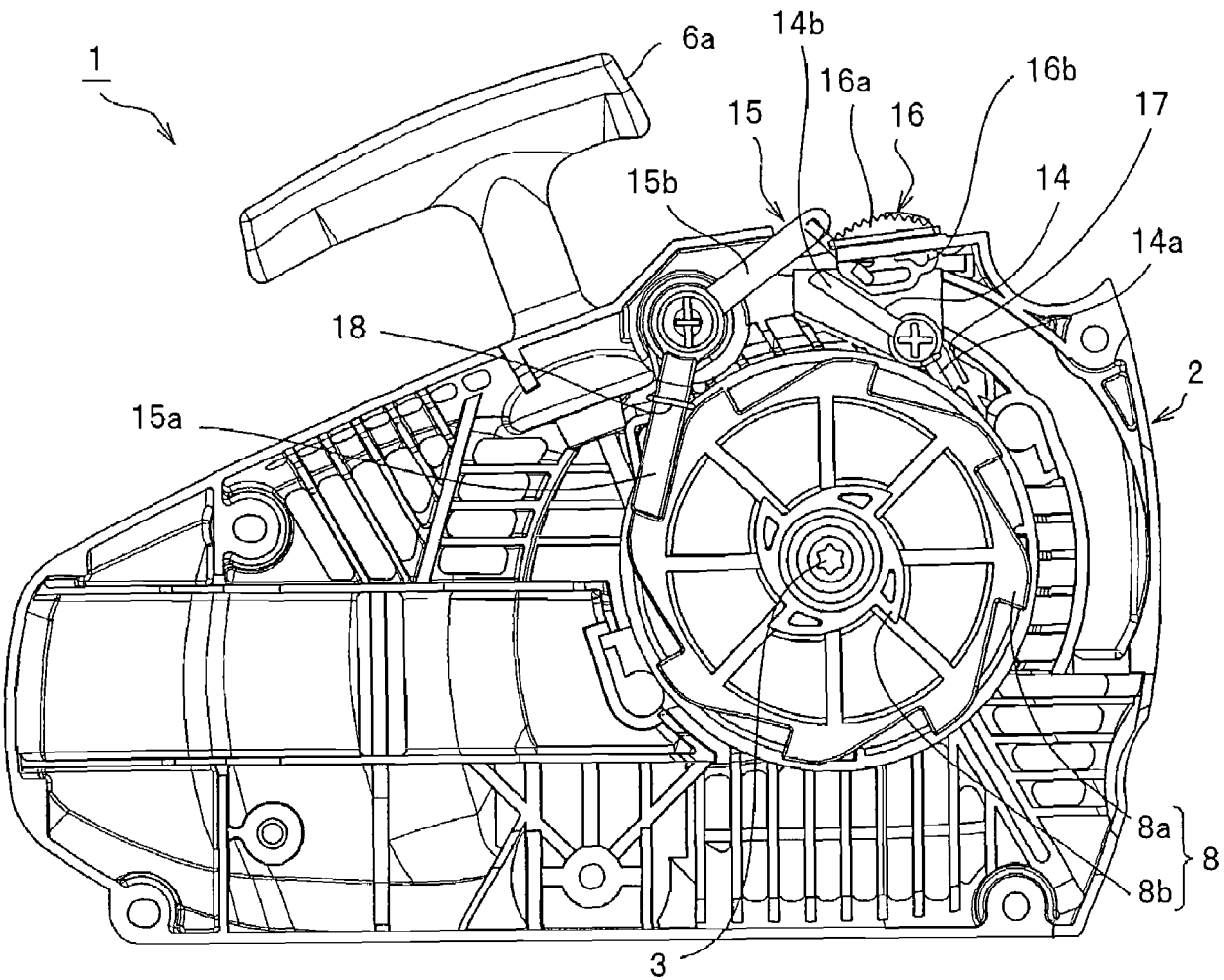
FIG. 5 is a plan view as seen from a cover case open side showing an internal state at a second start mode time of the same.

FIG. 1 is a cross sectional view showing one embodiment of an internal structure of a compact engine mounting the engine start device of the invention therein. FIG. 2 is an exploded perspective view of constituting members arranged in an inner portion of a cover case of the engine start device. FIG. 4 is an internal structure view showing a detaching state of mode switching means in the start device. FIG. 5 is an internal structure view showing an engaging state of start timing selecting means.

A compact engine 100 according to the present embodiment is provided, as shown in FIGS. 1 and 2, with an engine start device 1 of the invention, a ratchet wheel 8 in a rotation driven section side of the start device 1, a crank shaft 101 which automatically engages with and disengages from the ratchet wheel 8, a fan 102 firmly provided in the crank shaft 101, an engine main body 103 coupled to the crank shaft 101, an output shaft 104 coupled to the engine main body, an engine case 105 having these devices built-in, and an operating handle 106 provided between front and rear sides on an upper surface of the case 105 and provided in a vertical direction to a left surface in the way thereof. A throttle lever 106*a* and the like are installed to the operating handle 106.

The engine start device 1 is arranged close to one end portion of the crank shaft 101 in such a manner as to approximately bring its axis into line with the crank shaft 101 of the compact engine 100, as shown in FIG. 2. The engine start device 1 is structured such as to be accommodated and installed in the cover case 2 as shown in FIG. 2. A cylindrical boss portion 2*a* is provided in the case body 2 so as to protrude toward the crank shaft side. Each of the engine start members mentioned below is assembled sequentially in the cylindrical boss portion 2*a* so as to be fixed by a stop screw 3.

The engine start device 1 is provided with a rotation drive section D and a rotation driven section M. The rotation drive section D is provided with a recoiling power spring 4 in which an outer hook end is brought into contact with an inner surface of the case body 2; a power spring case 5 having formed in a center portion thereof a circular hole 5*a* to be externally fitted on the cylindrical boss portion 2*a*, the power spring case 5 accommodating the power spring 4 and being positioned and fixed in a contact state to the inner surface of the case body 2 together with the outer hook end of the recoiling power spring 4; a recoil rope 6 having a grip 6*a* in one end; and a recoiling reel 7 for fixing the other end of the recoil rope 6 to a winding peripheral surface so as to wind the recoil rope 6 therearound. On the other hand, the rotation driven section M is provided with a ratchet wheel 8 in which first and second ratchet portions 8*a* and 8*b* having different diameters are coaxially integrated and arranged. Damping and accumulating means in the embodiment is interposed between the rotation drive section D and the rotation driven section M.

Figure 3:
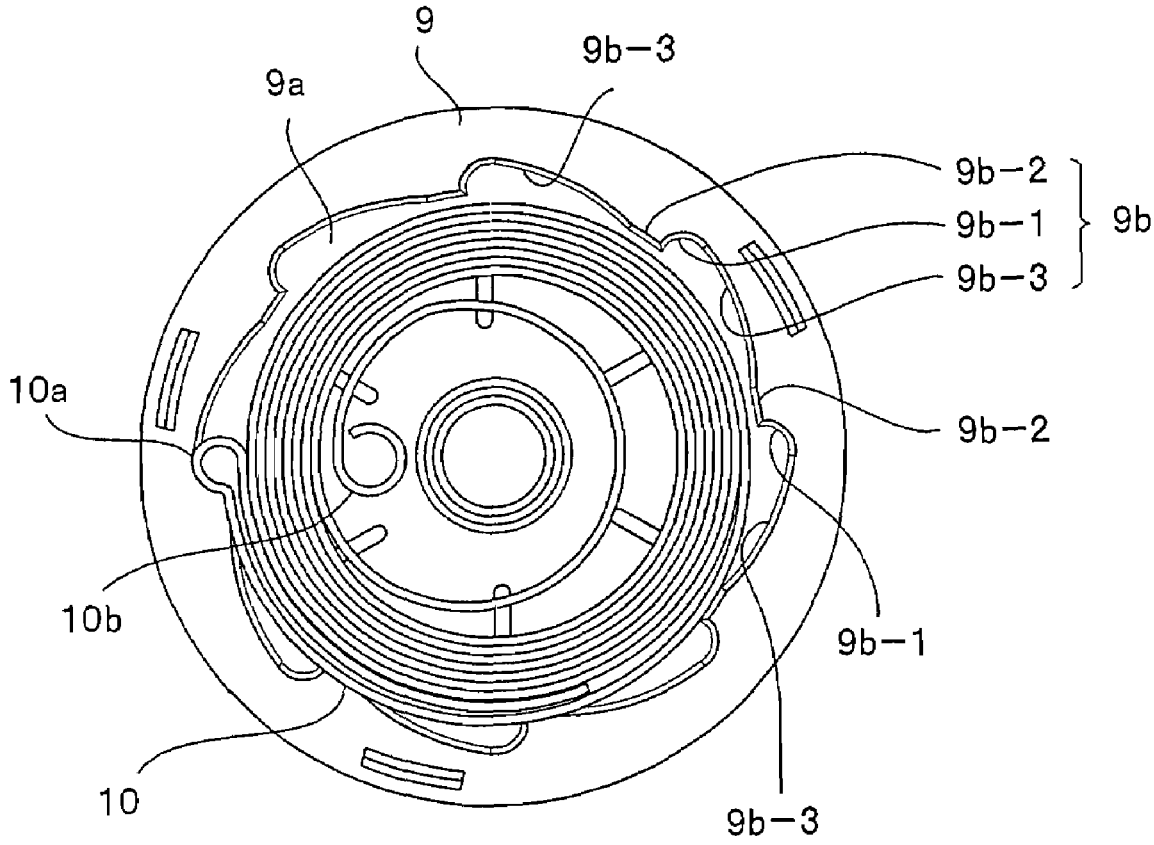
FIG. 3 is a plan view of an example of a torque limit mechanism additionally provided in the embodiment as seen from a barrel drum open side.

The damping and accumulating means has a barrel drum 9 constituted by a circular box body and an accumulating power spring 10 accommodated in the barrel drum 9, as shown in FIG. 2. In accordance with the embodiment, as shown in FIG. 3 in an enlarged manner, a plurality of protruding portions 9*b* are provided in a protruding manner at a uniform interval in an inner peripheral surface of an accommodating portion 9*a* of the barrel drum 9. The protruding portions 9*b* form a part of a torque limit mechanism in accordance with the invention. A shape of the protruding portion 9*b* is as follows. An outer hook portion 10*a* of the accumulating power spring 10 is engaged and attached in a rotating direction at an accumulating time of the recoiling reel 7 along an inner peripheral surface of the accommodating portion 9*a* of the barrel drum 9. An locking surface 9*b*-1 rotating the outer hook portion 10*a* in an accumulating direction of the accumulating power spring 10 is formed. Further, a slope surface 9b-3 downward sloping gently toward an inner peripheral surface of the accommodating portion 9a is formed from a peak run-over portion 9b-2 to a rear side in the rotating direction at the accumulating time. The inner hook portion 10b of the accumulating power spring 10 is firmly attached to a back surface portion close to a center cylindrical boss portion (not shown) of the ratchet wheel 8 of the rotation driven section M.

In the protruding portion 9b, if the barrel drum 9 is rotated in the accumulating direction and a desired accumulated force is accumulated in the accumulating power spring 10, the outer hook portion 10a of the accumulating power spring 10 is disengaged from the locking with the protruding portion 9b, and the outer hook portion 10a is going to run over the protruding portion 9b, so that the force is not accumulated in the accumulating power spring 10 even if the barrel drum 9 is rotated any more. At this time, if the barrel drum 9 keeps up the rotation, a run-over sound is generated at each time when the outer hook portion 10a of the accumulating power spring 10 runs over the protruding portion 9b, and informs a worker of the fact that the accumulated force reaches a desired amount. In the present invention, not only the torque limit mechanism is structured between the barrel drum 9 and the accumulating power spring 10, but also the torque limit mechanism is provided in the rotation driven section M as mentioned below. Accordingly, the structure is not limited to the present embodiment.

Further, on an outer peripheral surface of the barrel drum 9, there is formed an outer peripheral ratchet gear 9c serving as a one-way rotating mechanism allowing the rotation in the accumulating direction of the accumulating power spring 10 accommodated in the inner portion as shown in FIG. 2, but inhibiting the reverse rotation. A ratchet mechanism is generally employed as the one-way rotating mechanism, and it is possible to additionally employ a mechanism such as a one-way clutch, for example, having a bearing shape, and the installed position is not necessarily set to the outer peripheral surface of the barrel drum 9. A first engaging and disengaging member 14 of the invention is engaged with and disengaged from the outer peripheral ratchet gear 9c. On the other hand, a ratchet gear (not shown) is formed in a back surface opposing to the recoiling reel 7 of the barrel drum 9, and the barrel drum 9 is driven and rotated in the accumulating direction of the accumulating power spring 10 on the basis of the rotation of a driving piece 12 rotating together with the recoiling reel 7. The driving piece 12 has a cylindrical shaft portion 12a and a pair of wing piece portions 12b extending in a diametrical direction with a phase difference of 180° from an outer peripheral surface of the cylindrical shaft portion 12a, as shown in FIG. 2. The wing piece portion 12b is expanded toward a diametrical direction from a center of the cylindrical shaft portion 12a, and is structured such that a side surface in the accumulating direction of the barrel drum is thick and a side surface in the counter-accumulating direction is thin.

On the other hand, a projection 7a for positioning the wing piece portion 12b is provided in a protruding manner on a barrel drum side inner surface of the recoiling reel 7. Four projections 7a are provided on the barrel drum side inner surface of the recoiling reel 7 as shown in FIG. 2, and a layout of the projections 7a is obtained by arranging two sets of a pair of projections 7a for accommodating the wing piece portions 12b of the driving piece 12 in symmetrical to a center of rotation of the recoiling reel 7. A pair of wing piece portions 12b are accommodated and positioned between two sets of a pair of projections 7a. The pair of wing piece portions 12b are rotated together with the recoiling reel 7 on the basis of the contact of the projection 7a with the wing piece portion 12b at a time of rotating the recoiling reel 7.

The driving piece 12 is always pressed against the back surface of the barrel drum 9 by a compression spring 83, the thick portion of the wing piece portion 12b which rotates in the same direction on the basis of the rotation in the accumulating direction of the recoiling reel 7 is engaged with the ratchet gear (not shown) formed on the back surface of the barrel drum 9, and rotates the barrel drum 9 in the accumulating direction. At this time, the inner hook piece portion 10b of the accumulating power spring 10 accommodated in the inner portion of the barrel drum 9 is firmly attached to the ratchet wheel 8 of the driven section M, and the outer hook portion 10a is locked with the protruding portion 9b formed in the inner peripheral surface of the barrel drum 9 as mentioned above. Then, the accumulating power spring 10 rotates the barrel drum 9 in the accumulating direction until a desired accumulated force is accumulated. An open surface in the driven section side of the barrel drum 9 is closed by the annular cover 13, and regulates a movement in an axial direction of the accumulating power spring 10 accommodated in the inner portion.

The rotation driven section M is provided with the ratchet wheel 8 having the first and second ratchets 8a and 8b with the large diameter and the small diameter. The inner hook portion 10b of the accumulating power spring 10 is firmly attached to the ratchet wheel 8 as mentioned above, and a centrifugal clutch pawl provided in a crank shaft of an engine (not shown) is locked with the second ratchet 8b having the small diameter. Accordingly, the ratchet is in a standstill state without following to the rotation in the accumulating direction of the barrel drum 9 until the engine is started.

In FIG. 2, members denoted by reference numerals 14, 15 and 16 indicate most characteristic members of the present invention. Reference numeral 14 denotes a first engaging and disengaging member of the invention, which engages with and disengages from the outer ratchet gear 9c formed on the outer peripheral surface of the barrel drum 9. Reference numeral 15 denotes a second engaging and disengaging member of the invention, which engages with and disengages from the first ratchet 8a having the large diameter of the ratchet wheel 8. Reference numeral 16 denotes a slide switch corresponding to the mode switch operating means for engaging and disengaging the second engaging and disengaging member 15.

The first and second engaging and disengaging members 14 and 15 are formed in an L-shaped form, and bent portions thereof are rotatably pivoted to positions near an upper wall surface of a bottom portion of the cover case 2 side by side, as shown in FIGS. 4 and 5. The first engaging and disengaging member 14 is constituted by an engaging portion 14a which engages with and disengages from the outer peripheral ratchet gear 9c formed on the outer peripheral surface of the barrel drum 9 and an operating portion 14b which rotationally operates the engaging portion 14a around the bent portion. The first engaging and disengaging member 14 is urged by a torsional coil spring 17 in a direction in which the engaging portion 14a is engaged with the outer peripheral ratchet gear 9c of the barrel drum 9. On the other hand, the second engaging and disengaging member 15 is constituted by an engaging pawl portion 15a which engages with and disengages from the first ratchet 8a having the large diameter of the ratchet wheel 8 and an operating portion 15b which rotationally operates the engaging pawl portion 15a around the bent portion. The second engaging and disengaging member 15 is urged in one direction by a torsional coil spring 18 in a direction in which the engaging pawl portion 15*a* is engaged with the first ratchet 8*a* having the large diameter.

Further, in the present embodiment, the slide switch 16 is attached to the upper surface end portion of the cover case 2 in such a manner as to be slidable in a lateral direction in FIG. 4. As shown in FIGS. 4 and 5, a structure of the slide switch 16 has an operating piece 16*a* in which an upper portion is curved to an upper side so as to be evaginated and an upper surface is formed as a lot of concavo-convex surfaces, and a slide piece 16*b* which is provided so as to protrude to a lower side from a lower surface thereof and is fitted and inserted to a slit (not shown) formed in the cover case 2. The slide piece 16*b* is connected to a leading end portion of the operating portion 15*b* of the second engaging and disengaging member 15 by a link piece 19. One end of the link piece 19 is attached to a leading end portion of the operating portion 15*b* of the second engaging and disengaging member 15 so as to be rotatable with each other, and the other end of the link piece 19 is slidably attached to a slit 16*b*-1 formed in the slide piece 16*b*.

Further, the first and second engaging and disengaging members 14 and 15 are arranged in such a manner that the leading end portion of the operating portion 15*b* of the second engaging and disengaging member 15 pushes down the leading end portion of the operating portion 14*b* of the first engaging and disengaging member 14 from the above, and the engaging portion 14*a* of the first engaging and disengaging member 14 is disengaged from the outer peripheral ratchet gear 9*c* of the barrel drum 9, as shown in FIG. 4, in a state in which the second engaging and disengaging member 15 is disengaged from the large-diameter ratchet 8*a* of the ratchet wheel 8 via the link piece 19. Further, on the contrary, the constraint of the first and second engaging and disengaging members 14 and 15 with the link piece 19 is disconnected by sliding the slide switch 16 from a right side on the cover case in FIG. 4 to a left side shown in FIG. 5, and the first and second engaging and disengaging members 14 and 15 are rotated in a direction in which they are engaged with the outer peripheral ratchet gear 9*c* and the large-diameter ratchet 8*a* of the ratchet wheel 8 respectively on the basis of the elastic forces of the torsional coil springs 17 and 18.

In other words, in the present embodiment, if the slide switch is slid to the right side from the left side on the cover case 2 in FIG. 4, the first and second engaging and disengaging members 14 and 15 are disengaged from the engagement with the outer peripheral ratchet gear 8*c* of the barrel drum 9 and the large-diameter first ratchet 8*a* of the ratchet wheel 8. In this case, if the barrel drum 9 is rotated by pulling the recoil rope 6 so as to rotate the recoiling reel 7, a sufficient spring force is accumulated in the accumulating power spring 10, and the accumulated force reaches a sufficient force for starting the engine, the rotating force is transmitted to the crank shaft of the engine by actuating the centrifugal clutch (not shown) via the ratchet wheel 8 of the driven section M so as to start the engine. On the other hand, if the pulling operation of the recoil rope 6 is interrupted halfway, the barrel drum 9 and the ratchet wheel 8 starts reverse rotation, and the spring force of the accumulating power spring 10 accumulated till then is automatically released, because the barrel drum 9 and the ratchet wheel 8 of the driven section M are not engaged with the first and second engaging and disengaging members 14 and 15. As a result, even if the pulling operation of the recoil rope 6 is interrupted halfway so as to release a hand, and the accumulated force of the damping and accumulating means is naturally released. Thus, there is no risk that the engine is accidentally started. This is the first start mode in the present invention.

On the other hand, if the slide switch 16 existing in the right side on the cover case 2 in the first start mode is slid to the left side of the cover case 2, the first and second engaging and disengaging members 14 and 15 are exposed to the elastic forces of the torsional coil springs 17 and 18 so as to be engaged with the outer peripheral ratchet gear 9*c* of the barrel drum 9 and the large-diameter ratchet 8*a* of the ratchet wheel 8. In this state, it is possible to rotate the barrel drum 9 in the accumulating direction by pulling the recoil rope 6 so as to rotate the recoiling reel 7, but the rotation in the reverse direction is inhibited. At the same time, the ratchet wheel 8 of the driven section M is stopped rotating at all. Accordingly, if the recoiling reel 7 is rotated by pulling the recoil rope 6, the barrel drum 9 is rotated and only the force accumulation is executed in the accumulating power spring 10.

Accordingly, even if the pulling operation of the recoil rope 6 is interrupted halfway so as to release the hand, the accumulated force is maintained as it is between the barrel drum 9 and the ratchet wheel 8. Accordingly, for example, in the pulling operation by the worker having a weak power, or in the place in which the pulling operation of the recoil rope 6 can not be freely executed, the engine is started after pulling the recoil rope 6 in numbers and accumulating the sufficient spring force for starting the engine in the accumulating power spring 10. It is possible to securely know on the basis of the informative signal generated by the operation of the torque limit mechanism mentioned above whether or not the accumulated force accumulated at this time reaches the sufficient force for starting the engine. If the slide switch 16 is slid to the position of the original first start mode after the sufficient force is accumulated as mentioned above, the engagement between the second engaging and disengaging member 15 and the first ratchet 8*a* of the ratchet wheel 8 is first disconnected so as to instantaneously start the engine, and the engagement of the first engaging and disengaging member 14 with respect to the outer peripheral ratchet gear 9*c* of the barrel drum 9 is thereafter disengaged at the slight time difference as mentioned above. This state corresponds to the second start mode in the present invention.

As mentioned above, in accordance with the embodiment, it is possible to switch the mode between the first start mode and the second start mode by sliding the slide switch 16 on the surface of the cover case 2. In the first start mode, the recoiling reel 7 is rotated in the engine rotating direction on the basis of the pulling operation of the recoil rope 6 of the rotation drive section D, the desired spring force is accumulated in the accumulating power spring 10 while rotating the barrel drum 9 of the damping and accumulating means in the same direction, the accumulated force is directly transmitted to the ratchet wheel 8 corresponding to the driven section M, and the engine is automatically started if the accumulated force reaches the necessary and sufficient force for starting the engine. In the second start mode, previously accumulated is the necessary spring force for starting the engine in the accumulating power spring 10 by pulling the recoil rope 6 of the rotation drive section D so as to rotated the barrel drum 9 of the damping and accumulating means, the accumulated force accumulated in the power spring is released in the optional place at the desired time in the state in which the accumulated force is maintained, and the engine is started on the spot in a moment of time.

Further, a description will be specifically given of an engine start procedure of the embodiment on the basis of the first and second start mode switching with reference to the accompanying drawings.

In the case that the work is executed by the skilled worker in the wide place, and it is possible to start the engine at a stroke in the working place, the slide switch 16 is first slide to the first start mode side shown in FIG. 4. In this case, the recoil rope 6 wound around the recoiling reel 7 is strongly and quickly pulled out. During the pulling operation, the recoiling reel 7 is rotated in the rotating direction of the engine so as to rotate the barrel drum 9 via the driving piece 12 positioned in the recoiling reel 7 in the same direction. In the accumulating power spring 10 accommodated in the barrel drum 9, the outer hook portion 10*a* is locked with the locking surface 9*b*-1 of the protruding portion 9*b* which is a part of the torque limit mechanism formed on the inner peripheral surface of the barrel drum 9, and the inner hook portion 10*b* is fixed to the ratchet wheel 8 of the driven section M in the rotation stop state by the centrifugal clutch on the engine side (not shown). The rotating force at a time of rotating the barrel drum 9 is sequentially accumulated between the outer hook portion 10*a* and inner hook portion 10*b*.

The accumulated force is directly transmitted to the ratchet wheel 8, but does not rotate the ratchet wheel 8 of the driven section M until the centrifugal clutch is disengaged. If the accumulated force accumulated in the accumulating power spring 10 reaches a magnitude getting over a maximum load of the engine, the accumulated force rotates the centrifugal clutch (not shown) so as to start the engine. If the rotation of the engine is started and the engine comes into a normal speed, the centrifugal clutch is disengaged from the ratchet wheel 8 on the basis of the centrifugal force, and the rotation of the engine is continued. In this case, if the pulling operation of the recoil rope 6 is interrupted so as to release the hand, the recoiling power spring 4 accumulated on the basis of the pulling operation of the recoil rope 6 reverse rotates the recoiling reel 7 so as to be going to return to the original state, and automatically rewind the recoil rope 6.

In other words, the engine start in the first start mode mentioned above is limited to a time when the engine can be started on the basis of one pulling operation of the recoil rope. The engine start device at this time is broadly classified into two models. One of them is the engine start device disclosed in the patent documents 3, 4 and 6 mentioned above, and the other is the engine start device disclosed in the patent document 5 mentioned above. The former is of the type that the spring force of the power spring accumulated between the barrel drum and the driven section is maintained without being discharged even if the pulling operation of the recoil rope is interrupted halfway. The latter is of the type that, if the pulling operation of the recoil rope is interrupted halfway, the spring force of the power spring accumulated between the barrel drum and the driven section is naturally discharged because the barrel drum is reverse rotatable. These two types are not different in a point that if the spring force getting over the maximum load of the engine is accumulated between the barrel drum and the driven section, the engine is automatically driven.

Next, in the case that the worker has the weak power, or the working field exists on the tree or a rock and the periphery of the working place is narrow, so that it is necessary to execute the work in the field in which the engine cannot be started by one pulling operation of the recoil rope 6, the slide switch 16 first is checked out whether or not it is positioned in the second start mode. In other words, it is checked whether or not the first and second engaging and disengaging members 14 and 15 are respectively engaged with both the outer peripheral ratchet gear 9*c* of the barrel drum 9 and the ratchet wheel 8 of the driven section M. If the check of the second start mode is finished, the recoil rope 6 is pulled in the place in which the pulling operation of the recoil rope 6 can be executed. Then, the necessary accumulated force for starting the engine is applied to the accumulating power spring 10 between the barrel drum 9 and the ratchet wheel 8. The necessary accumulated force for starting the engine at this time can be known on the basis of the informative signal from the torque limiter.

In this case, the first and second engaging and disengaging members 14 and 15 are respectively engaged with both the outer peripheral ratchet gear 9*c* of the barrel drum 9 and the ratchet wheel 8 of the driven section M. Accordingly, since the barrel drum 9 is only rotated in the engine start direction and the rotation of the ratchet wheel 8 is forcibly stopped, the reverse rotation of the barrel drum 9 is not generated, and the accumulated force accumulated in the accumulating spring 10 arranged between the barrel drum 9 and the ratchet wheel 8 at this time is not naturally discharged. Therefore, in order to accumulate the necessary accumulated force for starting the engine, the necessary accumulated force may be accumulated by the plural times of pulling operation without depending on only one pulling operation.

After the sufficient force for starting the engine is accumulated in the accumulating power spring 10 as mentioned above, the worker goes to the working field in the state in which the engine is stopped, and slides the slide switch 16 mentioned above to the position close to the first mode there. On the basis of the sliding operation, the second engaging and disengaging member 15 is detached from the ratchet wheel 8 in the driven section M side, and the accumulated force of the accumulating power spring 10 is instantaneously released so as to rotate the ratchet wheel 8 at a high speed. On the basis of this rotation, the engine is started via the crank shaft (not shown). The first engaging and disengaging member 14 is rotated against the urging force of the torsional coil spring 17 while following to the operation of the second engaging and disengaging member 15 at the same time when the engine is started or at a slightly later timing thereof and the first engaging and disengaging member 14 is detached from the outer peripheral ratchet pawl portion 9*c* of the barrel drum 9. As mentioned above, almost all of the releasing force of the accumulating power spring 10 is used as the rotating force of the ratchet wheel 8 by delaying the engagement and disengagement of the first engaging and disengaging member 14 from the engagement and disengagement of the second engaging and disengaging member 15. Accordingly, it is possible to achieve an efficient rotation transmission.

It should be noted that the slide switch 16 for starting the engine is slid from the second start mode position to the first start mode position after accumulating the force in the accumulating power spring 10 in the second start mode as mentioned above. In other words, in accordance with the engine start device of the invention, the switching operation in the second start mode means always returning to the first start mode after finishing the engine start, in addition to the switch function for starting the engine. For this reason, when it is intended to start the engine particularly in accordance with the second start mode in the present invention, it is necessary to check out whether or not the mode is switched to the second start mode. However, it is not necessary to check out in the case that the engine is started in accordance with the first mode.

Figure 6:
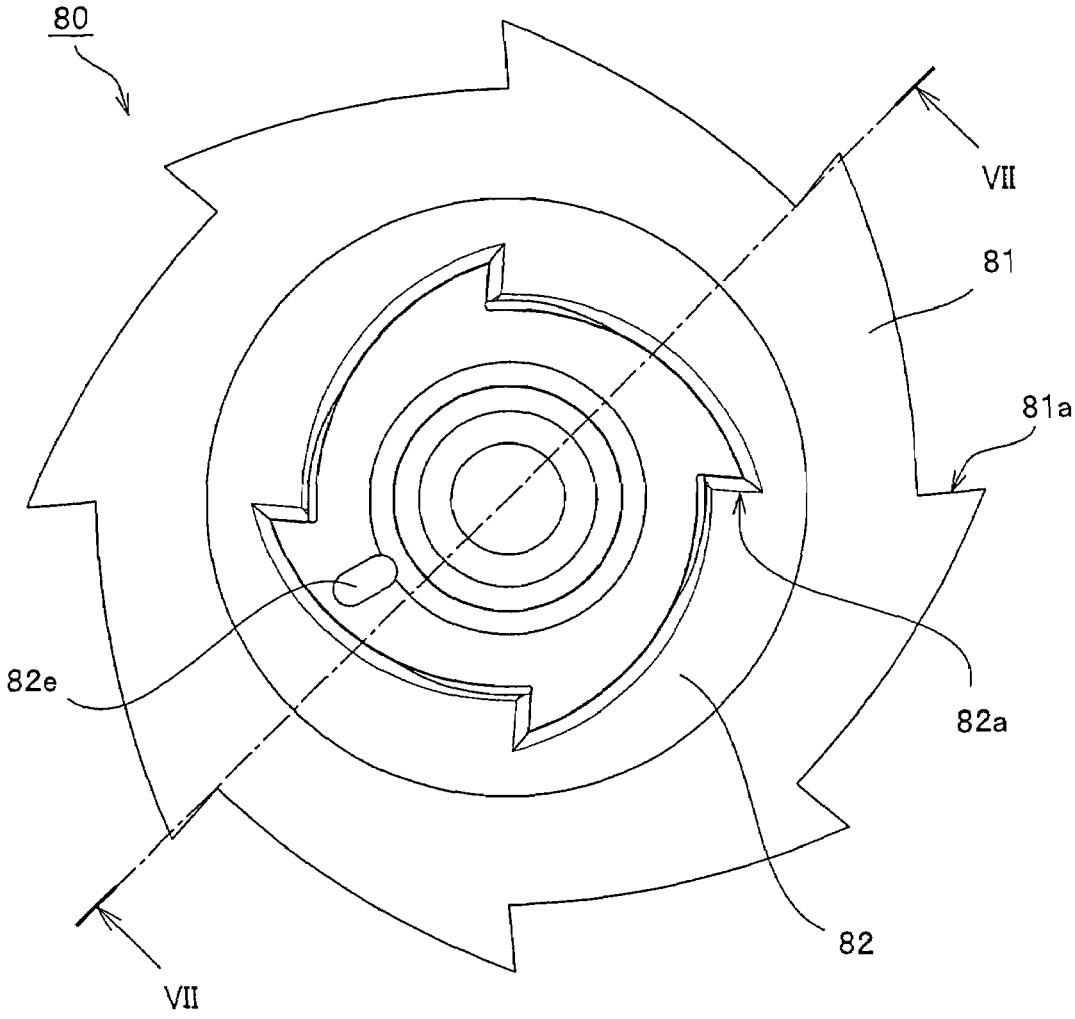
FIG. 6 is an outer appearance plan view showing another example of the torque limit mechanism applied to the invention.
Figure 7:
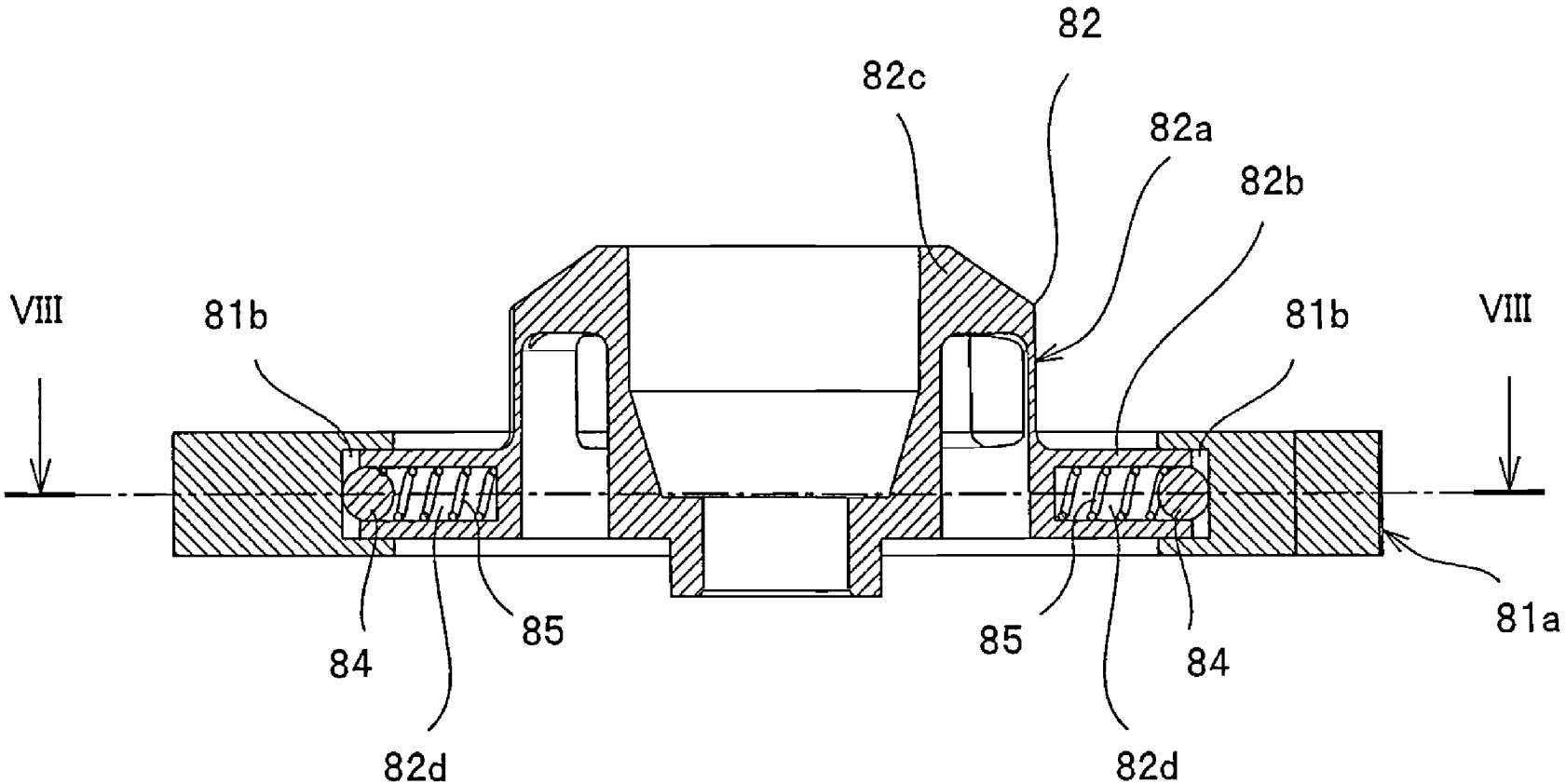
FIG. 7 is a cross sectional view as seen from an arrow along a line VII-VII in FIG. 6.
Figure 8:
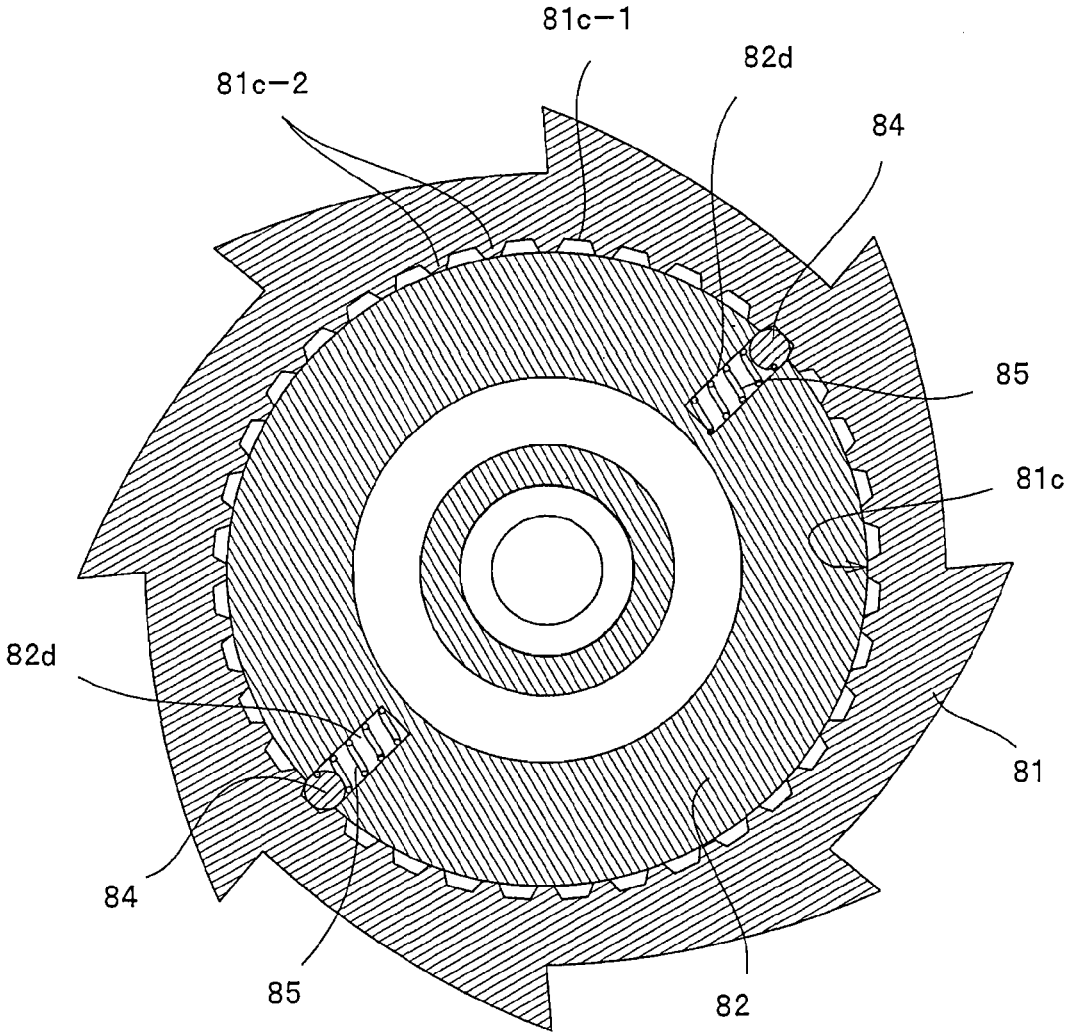
FIG. 8 is a cross sectional view as seen from an arrow along a line VIII-VIII in FIG. 7.

In this case, the torque limit mechanism in the present invention is not limited to utilize the locking mechanism between the barrel drum 9 and the accumulating power spring 10, but can employ the other torque limit mechanisms. FIGS. 6 to 8 show a ratchet wheel 80 of an engine start device corresponding to a second embodiment employing another torque limit mechanism. The torque limit mechanism is incorporated in the ratchet wheel 80 arranged in the driven section M in place of the barrel drum 9 in the first embodiment mentioned above. Accordingly, in the present embodiment, although an illustration is omitted, the inner hook portion 10*b* of the accumulating power spring 10 is firmly attached to a position close to a center portion in a back surface side of the ratchet wheel 80 in the same manner as the first embodiment, and the outer hook portion 10*a* of the accumulating power spring 10 is firmly attached to a part of the inner peripheral surface of the barrel drum 9 in the same manner as the conventional one. Therefore, in the embodiment, only the structure of the ratchet wheel 80 and the fixing structure of the accumulating power spring 10 are partly different, and the structures and the layouts of the other constituting members are not substantially different from the embodiment mentioned above. Accordingly, the following description will be given only of the structure of the ratchet wheel 80 having the torque limit mechanism built-in and the torque limit mechanism.

The ratchet wheel 80 of the embodiment is also provided with a large-diameter first ratchet 81 and a small-diameter second ratchet with a step on the same axis, in the same manner as the first embodiment. However, in the present embodiment, the first ratchet 81 and the second ratchet 82 are not fixedly integrated, but are assembled as independent bodies so as to be integrated in such a manner as to be relatively rotatable.

The large-diameter first ratchet 81 is constituted by an annular plate member in which a ratchet gear 81*a* is formed on an outer periphery as shown in FIGS. 7 and 8, an annular groove portion 81*b* continued in a peripheral direction is formed in an inner diameter portion thereof, and a concavo-convex surface 81*c* continued at the same pitch in the peripheral direction in the same manner is formed in a bottom surface thereof. On the other hand, in the small-diameter second ratchet 82, a large-diameter portion 82*b* and a small-diameter portion 82*c* are integrally formed with a step on the same axis as shown in FIG. 7, and the ratchet gear 82*a* is formed on an outer peripheral surface of the small-diameter portion 82*c*. Further, a thickness of the large-diameter portion 82*b* of the second ratchet 82 is set to such a dimension as to be slidably fitted to the annular groove portion 81*b* formed on the inner peripheral surface of the first ratchet 81, and two blind holes 82*d* extending toward a center direction are formed on the outer peripheral surface with a phase difference of 180 degree. A compression spring 85 is fitted to the blind hole 82*d*, and a small-diameter rigid ball 84 is fitted to an outer diameter side end portion.

If an outer peripheral portion of the large-diameter portion 82*b* of the second ratchet 82 is fitted to the annular groove portion 81*b* of the first ratchet 81, the rigid ball 84 is urged to an outer diameter side by the compression spring 85 so as to be pressed to the concavo-convex surface 81*c* formed in the annular groove 81*b* of the first ratchet 81. When the rigid ball 84 is fitted to a concave portion 81*c*-1 of the concavo-convex surface 81*c*, the first and second ratchets 81 and 82 are going to be integrally rotated or relatively rotated with a desired torque difference on the basis of a spring force of the compression spring 85. In this case, in the present embodiment, in order to achieve a weight saving of the apparatus, a rotation center portion of the second ratchet 82 is thinned so as to be formed hollow. Further, in FIG. 6, reference symbol 82*e* denotes a fixed hole to which the inner end portion of the accumulating power spring accommodated in the barrel drum (not shown) is fitted and fixed. However, a fitting and fixing method and a fixed position of the end portion of the accumulating power spring are not limited to the embodiment in the drawing on the second ratchet 82, and can be set in accordance with various aspects.

Next, a description will be briefly given of the engine start in the second start mode by the engine start device in accordance with another embodiment with reference to FIG. 2 showing the previous embodiment, although an illustration is omitted. In this case, since the torque limit mechanism functions in the same manner even if the engine is started in accordance with the first start mode, the description is here given only of the engine start in the second start mode.

Even in this present embodiment, the mode is first switched to the second start mode by operating the slide switch 16. After checking out the fact that the mode is switched to the second start mode in which the first and second engaging and disengaging members 14 and 15 are engaged with the outer peripheral ratchet gear 9*c* of the barrel drum 9 and the ratchet gear 81*a* of the first ratchet 81, the recoiling reel 7 is driven and rotated by pulling the recoil rope 6. The rotating force of the recoiling reel 7 is transmitted to the barrel drum 9 via the driving piece 12 so as to rotate the barrel drum 9 in the rotating direction of the engine. On the basis of the rotation of the barrel drum 9, the outer hook portion 10*a* is firmly attached to the inner peripheral surface of the barrel drum 9, and the inner hook portion 10*b* is firmly attached to the second ratchet 82, whereby the force is accumulated for the accumulated force accommodated in the barrel drum 9. If the accumulated force reaches a sufficient magnitude for starting the engine, the accumulated force for the force accumulation applied to the small-diameter second ratchet 82 is going to be released.

If the releasing force gets over the fitting force of the rigid ball 84 to the concave portion 81*c*-1 of the concavo-convex surface 81*c* formed on the inner peripheral surface of the large-diameter first ratchet 81 on the basis of the spring force of the compression spring 85, the rigid ball 84 is going to run over the convex portion 81*c*-2 of the concavo-convex surface 81*c*. Accordingly, in this state, the rigid ball 84 only runs over the convex portion 81*c*-2 of the concavo-convex surface 81*c* however pulling the recoil rope 6 thereafter. As a result, the small-diameter second ratchet 82 only runs idle, and the force is not accumulated in the accumulating power spring 10 any more. Further, in the case of this idle running, the run-over sound is generated at each time when the rigid ball 84 runs over the convex portion 81*c*-2 of the concavo-convex surface 81*c*, thereby informing the worker of the fact that the sufficient force for starting the engine is accumulated for the accumulation. Therefore, it is not necessary for the worker to extra pull the recoil rope 6.

If the sufficient force is accumulated in the accumulating power spring 10 as mentioned above, the state in which the engine can be started at any time is established. Accordingly, if the worker goes to the desired working field while keeping the engine stop after achieving the state, and slides the slide switch 16 to the first mode side at an optional start timing in the field, it is possible to start the engine in a moment. In this case, in order to prevent the slide switch 16 from accidentally moving to the first start mode side, the slide switch itself may be provided with a lock mechanism (not shown) which can be canceled at the same time of the operation, or an opening and closing lid for preventing the switch 16 from being operated until the lid is opened.

As is understood from the description mentioned above, in accordance with the engine start device of the present invention, it is possible to switch and select the first start mode in which the engine can be started only by pulling the recoil rope at one time in the case that the work is normally executed by the skilled worker, and the second start mode in which the necessary accumulated force for starting the engine is accumulated in the accumulating power spring by previously pulling in numbers in the case of the worker having the weak power or the work in the place in which the pulling operation is hard to be executed, or pulling at one time, and the engine can be sequentially started by the simple one operation at the optional timing in the working field. Further, in the case that the torque limit mechanism is additionally provided, the useless pulling operation of the recoil rope is not required.

The invention claimed is:

1. An engine start device comprising:

a rotation drive section;

a rotation driven section to which a rotation of the rotation drive section is transmitted; and a damping and accumulating device interposed between the rotation drive section and the rotation driven section, and accumulating a force while damping on the basis of a driving of the rotation drive section in a process of the driving the rotation drive section, and starting up an engine via the rotation driven section on the basis of the accumulated force, wherein the damping and accumulating device comprises a mode switching device switching a mode from a first start mode in which the rotation of the rotation drive section is directly transmitted to the rotation driven section via the damping and accumulating device, to a second start mode in which the rotation of the rotation drive section exclusively accumulates the force in the damping and accumulating device and releases the accumulated force accumulated in the damping and accumulating device at a desired time so as to rotate the rotation driven section, and the mode switching device comprises:

first and second engaging and disengaging members which engage with and disengage from each of the damping and accumulating device and the rotation driven section so as to respectively inhibit and allow a reverse rotation of the damping and accumulating device and the rotation driven section, and a single switch operating device which is configured to operate the first and second engaging and disengaging members together in mechanical cooperation such that the first and second engaging and disengaging members may be engaged with and disengaged from the damping and accumulating device and the rotation driven section, respectively, wherein said engagement and said disengagement respectively inhibit and allow a reverse rotation of the damping and accumulating device and the rotation driven section, and further wherein:

the first engaging and disengaging member is pivoted to a cover case of the start device, and integrally has an engaging portion which is urged toward an engaging and disengaging portion disposed around the damping and accumulating device, and an operating portion in cooperation with the second engaging and disengaging member so as to rotate the engaging portion in an engaging and disengaging direction, and the second engaging and disengaging member is pivoted to the cover case, and integrally has an engaging pawl portion which is urged in a locking direction of the rotation driven section, and an operating portion connected to the operating device so as to engage and disengage the engaging pawl portion with and from the rotation driven section.

2. The engine start device according to claim 1, wherein the first and second engaging and disengaging members are engaged with and disengaged from the damping and accumulating device and the rotation driven section at a switching time of the second start mode on the basis of an operation of the switch operating device in such a manner that an engagement of the first engaging and disengaging member is disengaged after a desired time has elapsed after disengaging an engagement of the second engaging and disengaging member by a time difference mechanism.

3. The engine start device according to claim 1, wherein the damping and accumulating device further comprises a barrel drum rotated by the driving of the rotation drive section and a power spring accommodated in the barrel drum, and the engaging portion of the first engaging and disengaging member is disposed around the barrel drum.

4. The engine start device according to claim 3, wherein each of the first and second engaging and disengaging members is formed as an L-shaped member, a center portion thereof being pivoted to the cover case.

5. The engine start device according to claim 1, further comprising a torque limit mechanism which operates at a time when the accumulated force by the damping and accumulating device exceeds a necessary load for starting the engine.

6. The engine start device according to claim 5, further comprising a signal generating device for generating a signal on the basis of an operation of the torque limit mechanism, at the time when the accumulated force by the damping and accumulating device exceeds the necessary load for starting the engine.

* * * * *